US007254991B2

(12) United States Patent
Stork et al.

(10) Patent No.: US 7,254,991 B2
(45) Date of Patent: Aug. 14, 2007

(54) METHOD FOR DETERMINING THE ROTATION ANGLE POSITION OF THE CAMSHAFT OF A RECIPROCATING-PISTON ENGINE IN RELATION TO THE CRANKSHAFT

(75) Inventors: Holger Stork, Buehl (DE); Heiko Dell, Buehlertal (DE); Minh Nam Nguyen, Buehl (DE)

(73) Assignee: Schaeffler KG, Herzogenaurach (DE)

( * ) Notice: Subject to any disclaimer, the term of this patent is extended or adjusted under 35 U.S.C. 154(b) by 169 days.

(21) Appl. No.: 11/213,003

(22) Filed: Aug. 26, 2005

(65) Prior Publication Data

US 2006/0042074 A1 Mar. 2, 2006

(30) Foreign Application Priority Data

Aug. 28, 2004 (DE) ..... 10 2004 041 712

(51) Int. Cl.
*G01M 15/00* (2006.01)

(52) U.S. Cl. ..... 73/117.3

(58) Field of Classification Search ..... 73/116, 73/117.2, 117.3, 118.1; 340/438, 439, 441; 701/29, 99, 101, 102, 110
See application file for complete search history.

(56) References Cited

U.S. PATENT DOCUMENTS 5,462,022 A 10/1995 Ushida ..... 123/90.17
5,548,995 A 8/1996 Clinton et al. ..... 73/116
5,715,780 A * 2/1998 Haller ..... 123/90.17

(Continued)

FOREIGN PATENT DOCUMENTS

DE 22 22 051 10/1984

(Continued)

*Primary Examiner*—Eric S. McCall
(74) *Attorney, Agent, or Firm*—Davidson, Davidson & Kappel, LLC

(57) ABSTRACT

In a method for adjusting the rotation angle position of the camshaft of a reciprocating-piston engine in relation to the crankshaft in which the crankshaft is in drive connection with the camshaft via an actuating gear, which is designed as a three-shaft gear having a drive shaft in a fixed mounting on the crankshaft, an output shaft in a fixed mounting on the camshaft and an actuating shaft which is in drive connection with an actuating motor, a measured value for the crankshaft rotation angle is determined for at least one crankshaft measurement point in time. For at least two actuating shaft measurement points in time, a measured value for the actuating shaft rotation angle is determined digitally. For at least one reference point in time which is after the crankshaft measurement point in time and the actuating shaft measurement point in time, an estimate for the rotation angle of the actuating shaft at the reference point in time is extrapolated from at least two actuating shaft rotation angle measured values, the time difference between the actuating shaft measurement points in time and the time interval between the latest actuating shaft measurement point in time and the reference point in time. A value for the rotation angle position is determined on the basis of the estimate, the at least one crankshaft rotation angle measured value and the transmission characteristic.

30 Claims, 6 Drawing Sheets

U.S. PATENT DOCUMENTS

| | | | | |
|---|---|---|---|---|
| 7,027,913 | B2 * | 4/2006 | Kobayashi et al. | 701/114 |
| 2002/0092499 | A1 * | 7/2002 | Kargilis et al. | 123/406.58 |
| 2003/0168044 | A1 * | 9/2003 | Rupp et al. | 123/406.18 |
| 2003/0226529 | A1 | 12/2003 | Takahashi et al. | 123/90.15 |
| 2004/0074289 | A1 * | 4/2004 | Galtier | 73/116 |
| 2005/0212508 | A1 * | 9/2005 | Damitz et al. | 324/207.2 |
| 2007/0012096 | A1 * | 1/2007 | Galtier et al. | 73/117.3 |

FOREIGN PATENT DOCUMENTS

| | | |
|---|---|---|
| DE | 102 36 506 | 2/2004 |
| DE | 103 15 317 | 3/2004 |
| GB | 1 395 823 | 5/1975 |
| WO | WO 2004/007919 | 1/2004 |
| WO | WO 2005/015019 | 2/2005 |

* cited by examiner

METHOD FOR DETERMINING THE ROTATION ANGLE POSITION OF THE CAMSHAFT OF A RECIPROCATING-PISTON ENGINE IN RELATION TO THE CRANKSHAFT

Priority is claimed to German Patent Application No. DE 10 2004 041 712.1, filed on Aug. 28, 2004, the entire disclosure of which is incorporated by reference herein.

The present invention relates to a method for determining the rotation angle position of the camshaft of a reciprocating-piston engine in relation to the crankshaft.

BACKGROUND

Such methods for determining the rotation angle position of the camshaft are known from practice. A planetary gear train provided as the actuating gear is connected by its drive shaft to a camshaft gear wheel in a non-rotatable manner, the latter being mounted rotatably in relation to the camshaft and being in drive connection with a crankshaft gear wheel via a drive chain. An output shaft of the actuating gear is in drive connection with the camshaft and an actuating shaft is in drive connection with an actuating motor. When the drive shaft is stationary, the gear ratio prevailing between the actuating shaft and the output shaft is selected by the actuating gear and is known as the stationary gear ratio. When the actuating shaft rotates, the gear ratio between the drive shaft and the output shaft increases or decreases, depending on the direction of rotation of the actuating shaft in relation to the camshaft gear wheel, so that the phase angle of the camshaft changes in relation to the crankshaft. In comparison with a method in which the internal combustion engine is operated at a constant phase angle, better cylinder filling of the internal combustion engine is achievable by adjusting the phase angle, thereby saving fuel, reducing emissions and/or increasing the output power of the internal combustion engine. To regulate the phase angle at a setpoint signal, the rotation angle of the crankshaft and the actuating shaft are first measured with the help of inductive sensors and then an actual value signal for the phase angle of the camshaft in relation to the crankshaft is determined with the help of the known stationary gear ratio. At a reference point in time, an interrupt is triggered in a microprocessor-based electronic control unit; with this interrupt, the measured value for the rotation angle of the actuating shaft is input into a regulating unit and compared with a setpoint signal that is made available. When a deviation occurs between the measured value and the setpoint signal, the regulating unit triggers the EC motor in such a way that the deviation is reduced. The rotation angle of the actuating shaft is measured with the help of magnetic field sensors which digitally detect the position of magnetic segments situated on the circumference of the EC motor rotor. However, since the measured values are digitized and the reference point in time differs from the measurement points in time of the actuating shaft, there are measurement inaccuracies which result in the measured relative rotation angle position of the camshaft executing a sawtooth oscillation about the actual rotation angle position. This has a negative effect on the control precision and also results in an increased power consumption by the EC motor.

SUMMARY OF THE INVENTION

An object of the present invention is to provide a method for determining the rotation angle position of the camshaft that will permit an accurate determination of the rotation angle position of the camshaft in relation to the crankshaft.

The present invention provides a method that includes extrapolating an estimate of the rotation angle of the actuating shaft at the reference point in time based on at least two measured values for the rotation angle of the actuating shaft, the time difference between the measurement points of the actuating shaft and the time interval between the latest measurement points in time of the actuating shaft and the reference point in time, and determining the value for the rotation angle position on the basis of the estimate, the at least one measured value for the rotation angle of the crankshaft and the transmission characteristic.

In an advantageous manner, the accuracy of the values for the phase angle is increased by estimating the angle by which the actuating shaft has rotated further between the latest measurement point in time of the actuating shaft and the particular instantaneous reference point in time and taking it into account in determining the values for the phase angle. The amplitude of the sawtooth oscillation executed by the measured curve of the rotation angle of the actuating shaft about the actual curve of the rotation angle of the actuating shaft is thus reduced accordingly. The method according to the present invention therefore permits high precision in determining the phase angle and low energy consumption by the actuating motor.

In the preferred embodiment of the present invention, a value for the angular velocity of the actuating shaft is determined for the latest measurement point in time of the actuating shaft, the estimate of the rotation angle of the actuating shaft at the reference point in time being determined from the latest measured values for the rotation angle of the actuating shaft, the time difference between the reference point in time and the latest measurement point in time of the actuating shaft and from the angular velocity value. The measured value of the actuating shaft rotation angle at the reference point in time is thus determined by linear interpolation from the latest measured value of the actuating shaft rotation angle with the help of the angular velocity value. The angular velocity value may be calculated from the angle difference between the two latest measured angular velocity values and the time difference between the measurement points in time associated with these angular velocity values.

In an advantageous embodiment of the present invention, the actuating motor is an EC motor having a stator with a winding and rotor non-rotatably attached to the actuating shaft, magnetic segments magnetized in opposite directions being arranged in alternation and offset relative to one another in the circumferential direction, these magnetic segments having tolerances with regard to their positioning and/or dimensions, the position of the magnetic segments in relation to the stator being detected for determination of the measured values of the rotation angle of the actuating shaft and/or the angular velocity values, at least one correction value being detected for compensation of the influence of at least one tolerance on the measured values of the rotation angle of the actuating shaft, and whereby the measured values of the rotation angle of the actuating shaft and/or the angular velocity values are corrected with the help of the correction value. This embodiment is based on the finding that when a magnetic segment of the rotor which is subject to tolerances moves repeatedly back and forth past a magnet sensor situated in a stationary position in relation to the stator, the position measurement signal detected with the help of the magnetic sensor for the corresponding magnetic segment always has the same error in each passage of the magnetic sensor due to the tolerance in the magnetic segment. This error is determined by measurement or by some other method, and then a correction value is determined using which the measured values for the rotation angle of the actuating shaft are corrected at a later point in time when the particular magnetic segment passes by the magnetic field sensor again. Thus a measurement inaccuracy caused by the tolerance of a magnetic segment is easily corrected in the rotational speed signal. It is even possible to perform this correction online at the rotational speed value currently measured without any time lag between the corrected and uncorrected rotational speed values.

It is advantageous if the position of the magnetic segments is detected with the help of a measuring device having multiple magnetic field sensors on the stator situated in the circumferential direction of the stator so they are offset in relation to one another, in such a way that a number of magnetic segment-sensor combinations is run through per revolution of the rotor in relation to the stator; it is also advantageous if a correction value is determined for each of these magnetic segment-sensor combinations and stored and used to correct the measured values for the rotation angle of the actuating shaft and/or the angular velocity. The phase angle of the camshaft in relation to the crankshaft may then be adjusted with even greater precision. The number of magnetic segment-sensor combinations preferably corresponds to the product of the number of magnetic field sensors by the number of magnetic poles of the rotor.

In a preferred embodiment of the present invention, the rotor is rotated in relation to the stator so that it passes through a number of magnetic segment-sensor combinations, first uncorrected measured values for the rotation angle of the adjusting shaft and/or angular velocity values being determined for these magnetic segment-sensor combinations with the help of the measuring device, reference values also being determined for the rotation angle of the actuating shaft and/or the angular velocity, these reference values having a greater accuracy than the first measured values of the rotation angle of the actuating shaft and/or angular velocity values, the correction values being determined as correction factors with the help of the first uncorrected measured values for the rotation angle of the actuating shaft and/or angular velocity values, the magnetic segment-sensor combinations associated with the first uncorrected measured values for the rotation angle of the actuating shaft and/or angular velocity being run through again and second uncorrected measured values for the rotation angle of the actuating shaft and/or angular velocity being determined with the help of the measuring device and these values being corrected with the help of the previously determined correction factors. The correction values are determined in the form of correction factors so that a correction of the measurement errors caused by the tolerances of the magnetic segment is possible at different rotational speeds. The reference signal may be a measurement signal which is detected, e.g., at the time of the manufacture of the EC motor with the help of an additional position measuring device. The reference signal may also be a rotational speed signal and/or an integrated acceleration signal of a shaft connected to the EC motor.

In an expedient embodiment of the present invention, the reference values are formed by smoothing the first uncorrected measured values of the rotation angle of the actuating shaft and/or angular velocity by filtering. This makes it possible to eliminate an additional sensor for measuring the reference signal.

It is advantageous if the rotor is rotated in relation to the stator so that the individual magnetic segment-sensor combinations occur at least twice when a correction factor for the measured values for the rotation angle of the actuating shaft and/or the angular velocity is determined for each individual magnetic segment-sensor combination when an average is formed from the correction factors determined for the individual magnetic segment-sensor combinations and when the averages thus obtained are stored as new correction factors and the measured values for the rotation angle of the actuating shaft and/or the angular velocity are corrected with the help of these corrections factors in a new passage of the magnetic segment-sensor combinations. The individual magnetic segment-sensor combinations are preferably run through as often as possible, which is possible with no problem in the case of an EC motor for an electronic camshaft adjustment because it is constantly rotating during operation of the internal combustion engine.

In one embodiment of the present invention, the arithmetic mean is formed as the average. All the correction values used to form the average here enter into the average with the same weight.

In a preferred embodiment of the present invention, a sliding average is used as the average, preferably in such a way that the weight with which the correction factors enter into the average decreases with advancing age of the correction factors. New correction factors are thus taken into account to a greater extent on the average than are correction factors associated with a point in time farther in the past. Should an error occur resulting in a magnetic segment-sensor combination not being detected and therefore the correction factors already determined being associated with the wrong magnetic segment, then the wrong correction factor association has only a brief effect on the correction of the rotational speed signal, i.e., the wrong correction factors are "forgotten" relatively quickly.

It is advantageous if sliding averages $F_{new}[i(t-T)]$ for individual magnetic segment-sensor combinations are determined cyclically using formula $F_{new}[i(t-T)]=\lambda F_{old}[i(t-T)]+(1-\lambda)F[i(t-T)]$, where i is an index identifying the particular magnetic segment-sensor combination, t is time, T is a lag time between the actual angular velocity and the measured angular velocity values, $F_{old}[i(t-T)]$ is the average determined at index i in the latest averaging and $\lambda$ is a forgetting factor which is greater than zero and less than one, preferably being in the interval between 0.7 and 0.9. Such averaging is particularly suitable for the online calculation. Time T depends on the rotational speed and decreases with an increase in rotational speed (event-controlled system).

In an advantageous embodiment of the present invention, a) the rotor rotates in relation to the stator and the correction factors are determined and stored for the individual magnetic segment-sensor combinations, b) the corresponding magnetic segment-sensor combinations are then run through again, determining a set of new correction factors, c) the correction factors of the old correction factor set are replaced cyclically in relation to those of the new correction factor set and the correction factor sets are then compared, d) step c is repeated until all permutations of the old correction factor set with the new correction factor set have been compared, e) the permutation with which a maximum correspondence with the new correction factor is obtained is determined, f) and the angular velocity values are corrected using the arrangement of correction values of the old set of correction factors associated with this permutation.

In this way, the association of the correction factors with the magnetic segments is restorable if it has been altered unintentionally, e.g., because of a disturbance in the measurement signal. Thus the correction factors already determined may continue to be used after the occurrence of the disturbance. An identifier on the rotor of the EC motor permitting an absolute measurement of the position of the rotor in relation to the stator may be omitted. However, this method may also be used advantageously after restarting the EC motor to associate correction factors determined during an earlier on-phase of the EC motor and stored in a non-volatile memory, to those magnetic segment-sensor combinations for which they were determined during the earlier on-phase. If necessary, the correction factors may also be determined under ideal conditions at the time of manufacture of the EC motor, preferably in a final manufacturing stage.

It is advantageous if an average is formed from correction factors associated with one another of the old and new correction factor sets in the permutation in which there is a maximum correspondence between the correction factor sets and this average is stored as a new correction factor, and if the angular velocity values are corrected using the correction factor set obtained by this averaging. Thus, both the correction factors of the first data set as well as those of the second data set are taken into account in correcting the angular velocity values.

In a preferred embodiment of the present invention, a) the rotor rotates in relation to the stator in such a way that all magnetic segment-sensor combinations are run through at least once, b) a position measurement signal of the magnetic field sensors is generated in such a way that a number of measurement signal states is run through per each revolution of the EC motor for each pole pair of the rotor, c) a first data set having a number of value combinations corresponding to the number of magnetic segment-sensor combinations, each including at least one correction factor for the particular magnetic segment-sensor combination and a measurement signal state associated with it, is determined and stored, d) the corresponding magnetic segment-sensor combinations are then run through again, determining and saving a new second data set and the corresponding value combinations, e) when there is a deviation between the measurement signal states of the first data set and those of the second data set, the value combinations of the first data set are shifted cyclically in relation to those of the second data set so that the measurement signal states of the data sets match, f) the correction factors of the data sets associated with one another are then compared, g) the correction factors of the one data set are cyclically permutated by a number of steps corresponding to twice the number of magnetic field sensors in relation to the correction factors of the other data set and then the correction factors of the data sets associated with one another are compared, h) step g) is repeated, if necessary, until all permutations have been processed, i) a permutation in which a maximum correspondence occurs between the correction factors of the data sets is determined and j) the angular velocity values are corrected using the arrangement of correction values of the first data set associated with this permutation.

Through these measures it is possible to restore the association of correction factors with the magnetic segment-sensor combinations in relatively few permutations, i.e., shift operations, and thus in a small amount of time.

It is even possible to form an average from the correction factors of the first and second data sets associated with one another in the permutation at which a maximum correspondence between the correction factors of the data sets occurs and to store it as a new correction factor and to correct the angular velocity values using the correction factor set obtained by this averaging. Thus both the correction factors of the first data set as well as those of the second data set are taken into account in the correction of the rotational speed signal.

In an expedient embodiment of the method, the ranges of fluctuation in the uncorrected angular velocity values and the correct angular velocity values are determined in a time window and compared, the correction factors being newly determined for the case when the range of fluctuation in the corrected angular velocity values is greater than that of the uncorrected angular velocity values and/or the association of the correction factors with the magnetic segment-sensor combinations being restored. For the case when the fluctuation in the corrected angular velocity values is greater than that of the uncorrected angular velocity values, it is assumed that an error has occurred in associating the correction factors with the individual magnetic segment-sensor combinations, e.g., due to EMC incident radiation. To correct this error, the correction factors may be reset at a value of 1 and then re-adapted or the original association may be restored, e.g., by cyclic permutation of the correction factors.

The correction factors are expediently limited to a predetermined value range which is preferably between 0.8 and 1.2. Therefore, freak values in the corrected rotational speed signal caused by implausible correction factors outside of the specified value range may be suppressed.

In an advantageous embodiment of the present invention, a moment of inertia is determined for the mass moment of inertia of the rotor, a current signal I being determined by determining a current value I(k) for the electric current in the winding for the individual measurement points in time of the actuating shaft, an estimate $\omega_s(k)$ being determined for the angular velocity value $\omega(k)$ for the individual angular velocity values $\omega(k)$ from an angular velocity value $\omega_k(k-1)$ associated with an earlier actuating shaft measuring point in time, current signal I and from the moment of inertia value, a tolerance band containing estimate $\omega_s(k)$ being associated with this estimate $\omega_s(k)$, and for the case when angular velocity value $\omega(k)$ is outside the tolerance band, angular velocity value $\omega(k)$ is replaced by an angular velocity value $\omega_k(k)$ within the tolerance band. Thus, angular velocity values $\omega(k)$ outside of the tolerance band and therefore implausible are limited to the tolerance band, the limit values of which are determined dynamically. Therefore, fluctuations in angular velocity values are easily smoothed without resulting in any mentionable time lag between the smoothed, i.e., corrected, angular velocity signal and the measured angular velocity signal. The limit is based on the dynamic equation of the electric machine:

$$J \cdot d\omega/dt = K_t \cdot I$$

where J is the mass moment of inertia of the rotor, ω is the rotor rotational speed, $K_t$ is a constant of the electric machine, I is the winding current and t is time. Rotational speed estimate $\omega_s(k)$ may be determined as follows, where T is a sampling period:

$$\omega_s(k) = \omega_k(k-1) + \frac{T \cdot K_t \cdot I(k-1)}{J}$$

If the width of the tolerance band is set at $\pm\Delta\omega_{limit}$, then upper boundary value $\omega_{HighLim}(k)$ and lower boundary value $\omega_{LowLim}(k)$ of the tolerance band for the kth rotational speed measured value ω(k) may be determined as follows, based on estimate $\omega_s$:

$$\omega_{HighLim}(k) = \omega_s + \Delta\omega_{limit} = \omega(k-1) + \frac{T \cdot K_t \cdot I(k-1)}{J} + \Delta\omega_{limit}$$

$$\omega_{LowLim}(k) = \omega_s - \Delta\omega_{limit} = \omega(k-1) + \frac{T \cdot K_t \cdot I(k-1)}{J} - \Delta\omega_{limit}$$

Width $\pm\Delta\omega_{limit}$ of the tolerance band is preferably selected here to be much smaller than the range of variation in rotational speed measured values ω(k) to achieve a tangible reduction in the fluctuation of the angular velocity values.

In an advantageous embodiment of the present invention, a load torque is applied to the rotor, signal $M_L$ being supplied for the load torque and estimate $\omega_s(k)$ being determined from angular velocity value $\omega_k(k-1)$, current signal I, load torque signal $M_L$ and the moment of inertia associated with the earlier sampling point in time. The dynamic equation of the EC motor is then:

$$J \cdot d\omega/dt = K_t \cdot I - M_L.$$

Angular velocity estimate $\omega_s(k)$ as well as upper boundary value $\omega_{HighLim}(k)$ and lower boundary value $\omega_{LowLim}(k)$ of the tolerance band may be determined from this as follows:

$$\omega_s(k) = \omega_k(k-1) + \frac{T \cdot K_t \cdot I(k-1)}{J} - \frac{T \cdot M_L(k-1)}{J}$$

$$\omega_{HighLim}(k) = \omega_s + \Delta\omega_{limit} = \omega(k-1) + \frac{T}{J[K_t I(k-1) - M_L(k-1)]} + \Delta\omega_{limit}$$

$$\omega_{LowLim}(k) = \omega_s - \Delta\omega_{limit} = \omega(k-1) + \frac{T}{J[K_t I(k-1) - M_L(k-1)]} - \Delta\omega_{limit}$$

In an expedient embodiment of the present invention, the electric voltage applied to the winding is determined, current values I(k) being determined indirectly from the voltage, the impedance of the winding, rotational speed measured value ω(k), corrected if necessary, and a motor constant $K_e$. The corresponding system equation is as follows:

$$U = R_A \cdot I + L_A \cdot dI/dt + K_e \cdot \omega_k$$

where $R_A$ is the ohmic resistance of the winding, $L_A$ is the inductance of the winding and $K_e$ is the motor constant of the EC motor. This method is preferably used with EC motors in which the winding current is adjusted by pulse width modulation of an electric voltage applied to the winding.

It is advantageous if the width and/or position of the tolerance is/are selected as a function of angular velocity value $\omega_k(k-1)$ associated with the earlier adjusting angle measurement point in time and is preferably reduced with an increase in angular velocity and/or increased with a decrease in angular velocity. If there is an average for the load torque of the camshaft, the accuracy of which depends on the rotational speed, then the dependence of the accuracy on the rotational speed may be taken into account in determining the width of the tolerance band.

In an expedient embodiment of the present invention the width and/or position of the tolerance band is/are selected as a function of current signal I and preferably increased with an increase in current and/or reduced with a decrease in current. It is assumed here that with a large winding current, the rotor is usually accelerated so that the rotational speed increases accordingly. The width and/or position of the tolerance band is thus adjusted to the changes in rotational speed of the rotor to be expected on the basis of the electric current supplied to the winding.

If the rotational speed signal is subject to interference, e.g., ripple, then the winding current usually fluctuates accordingly. In this case it may be advantageous for current signal I to be smoothed by filtering, in particular by forming a sliding average, and estimates $\omega_s(k)$ for angular velocity values ω(k) to be determined with the help of filtered current signal I.

In an advantageous embodiment of the present invention, an estimate of the rotation angle of the crankshaft at the reference point in time is extrapolated from at least two crankshaft rotation angle measured values, from the time difference between the crankshaft rotation angle measurement points in time associated with these measured values and from the time interval between the latest crankshaft measurement point in time and the reference point in time, the time difference between the reference point in time and the latest crankshaft measurement point in time being determined and the estimate being determined from the crankshaft rotation angle measured value at the latest crankshaft measurement point in time, the time difference and the angular velocity value. Using this measure, in combination with the extrapolation of the adjusting measurement points in time, a particularly high precision is achievable in setting the phase angle.

BRIEF DESCRIPTION OF THE DRAWINGS

Exemplary embodiments of the present invention are explained in greater detail below with reference to the drawings, in which:

FIG. 7 shows a graph of correction factors, the absolute values of the correction factors being depicted as a bar chart, a value of the position measurement signal associated with the particular correction factor being shown beneath the bar, and an index associated with the particular correction factor of a magnetic segment-sensor combination being shown beneath that.

DETAILED DESCRIPTION

An adjusting device for adjusting the rotation angle position or phase angle of camshaft 11 of a reciprocating-piston engine in relation to crankshaft 12 has an actuating gear 13 which is designed as a three-shaft gear having a drive shaft fixedly mounted on the crankshaft, an output shaft fixedly mounted on the camshaft, and an actuating shaft in drive connection with a rotor of an actuating motor. For determining measured values for the phase angle, a measured value for the crankshaft rotation angle is determined at the crankshaft measurement points in time. In addition, a measured value for the actuating shaft rotation angle is measured at the actuating shaft measurement points in time. With the help of a known stationary gear ratio of the three-shaft gear, a value for the phase angle is determined from the measured value for the crankshaft rotation angle and the actuating shaft rotation angle.

Figure 1:
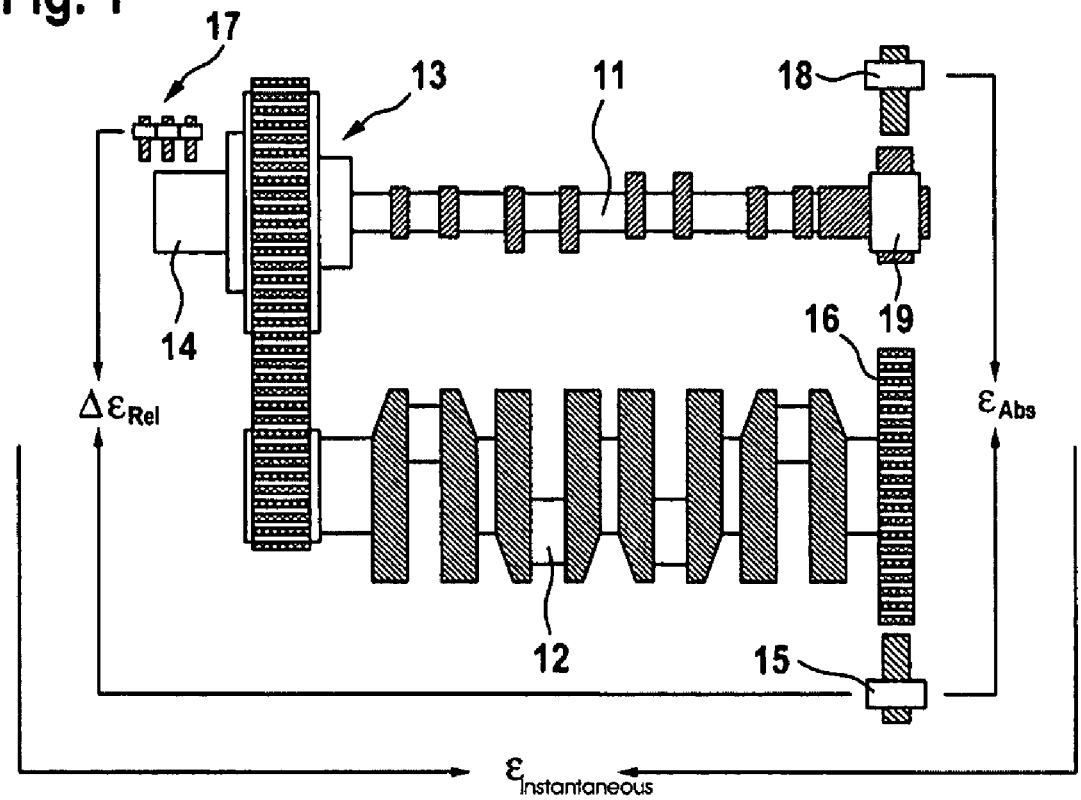
FIG. 1 shows a schematic diagram of a crankshaft-camshaft arrangement of a reciprocating-piston engine having an adjusting device for altering the rotation angle position of the camshaft in relation to the crankshaft.

FIG. 1 shows that an inductive sensor 15 which is provided for measuring the crankshaft rotation angle detects the tooth flanks of a ring gear 16 made of a magnetically conducting material and situated on crankshaft 12. One of the tooth spaces or teeth of ring gear 16 has a greater width than the other tooth spaces and/or teeth and functions as a reference mark. The measured value for the crankshaft rotation angle is set at a starting value when it passes the reference mark on sensor 15. The measured value is then corrected until passing by the reference mark on sensor 15 again each time a tooth flank is detected. This correction of the measured value for the crankshaft angle is performed with the help of a control unit in which an interrupt is triggered in the operating program each time it detects a tooth flank. The crankshaft rotation angle is thus measured digitally.

An EC motor 14 is provided as the actuating motor; it has a rotor having a number of magnetic segments magnetized alternately in opposite directions on its circumference and cooperating with teeth on a stator via an air gap. The teeth are wound with a winding which receives electric current via a triggering device.

The position of the magnetic segments in relation to the stator and thus the actuating shaft rotation angle is detected with the help of a measuring device 17 having multiple magnetic field sensors A, B, C on the stator, these sensors being arranged offset from one another in the circumferential direction of the stator in such a way that a number of magnetic segment-sensor combinations is run through per revolution of the rotor. A Hall sensor 18 provided as the reference value generator for the camshaft rotation angle cooperates with a trigger wheel 19 provided on camshaft 11. When Hall sensor 18 detects a flank of trigger wheel 19, an interrupt is triggered in the operating program of the control unit, temporarily storing the crankshaft rotation angle and the actuating shaft rotation angle. This interrupt is also referred to below as the camshaft interrupt.

Camshaft-triggered absolute angle $\epsilon_{Abs}$ and relative adjusting angle $\Delta\epsilon_{Rel}$ are compensated by instantaneous adjusting angle $\epsilon_{inst}$. A signal representing instantaneous adjusting angle $\epsilon_{inst}$ is applied to an actual value input of a regulating circuit provided for regulating the phase angle. Absolute angle $\epsilon_{Abs}$ is the crankshaft angle at a point in time $t_{TrigNW}$ at which the camshaft interrupt is triggered:

$$\epsilon_{Abs}=\epsilon_{KW}(t_{TrigNW})$$

Rotation angle position $\Delta\epsilon_{Rel}$ of camshaft 11 in relation to crankshaft 12 is calculated from the synchronous changes (regulator sampling) of the angle counter of the rotor $\Delta\phi_{Em}$ and of the crankshaft $\Delta\phi_{KW}$ based on the reference values in camshaft triggering using the basic gear equation of the three-shaft gear:

$$\varepsilon_{inst} = \varepsilon_{\mathrm{Abs}} + \varepsilon_{Rel} = \varepsilon_{\mathrm{Abs}} + \frac{1}{i_g}\cdot(\Delta\phi_{KW} - 2\cdot\Delta\phi_{Em}) \tag{1.1}$$

$$\varepsilon_{inst} = \phi_{KW,TrigNW} + \frac{1}{i_g}\cdot([\phi_{KW} - \phi_{KW,TrigNW}] - \cdot[\phi_{Em} - \phi_{Em}2_{,TrigNW}])$$

In this equation, $i_g$ is the stationary gear ratio between camshaft 11 and the actuating shaft:

$$i_g = \frac{n_{Em}}{n_{NW}}\Big|_{n_{Kw}=0}$$

To be able to calculate rotation angle position $\Delta\epsilon_{Rel}$, the angles of crankshaft $\phi_{KW,TrigNW}$ and the EC rotor motor and/or actuating shaft $\phi_{Em,TrigNW}$ at the point in time of the camshaft trigger are stored. At a later point in time, an interrupt is triggered in the operating program of the control unit, at which point rotation angle position $\Delta\epsilon_{Rel}$ is calculated with the help of temporarily stored angles $\phi_{KW,TrigNW}$ and $\phi_{Em,TrigNW}$. This interrupt is also referred to below as a cyclic interrupt.

The resolution of relative rotation angle position $\Delta\epsilon_{Rel}$ is obtained by an uncertainty analysis of the individual components of equation (1.1). The crankshaft rotation angle has an uncertainty of −0° to +0.2°, for example. Resolution $\delta_{Em}$ of measuring device 17 is obtained from the number of pole pairs P (e.g., P=7) and number m (e.g., m=3) of magnetic field sensors A, B, C:

$$\delta_{Em} = \frac{360°}{2\cdot m\cdot P} = \frac{360°}{2\cdot 3\cdot 7} = 8.57°,$$

where the uncertainty band (at a positive rotational speed) may be set on a single side from −0° to +8.57° because the angle is always assumed to be exact at the point in time of a change in the magnetic segment-sensor combinations and then increases. If relative rotation angle position $\Delta\epsilon_{Rel}$ were calculated directly from crankshaft rotation angle $\phi_{KW,TrigNW}$ and actuating shaft rotation angle $\phi_{Em,TrigNW}$, this would yield a measurement uncertainty from −0.29° to +0.49° for relative rotation angle position $\Delta\epsilon_{Rel}$:

$$\varepsilon_{-0.29}^{+0.49} = \varphi_{KW,TrigNW}{}_{-0}^{+0.2} + \frac{1}{i_g}([\varphi_{KW}{}_{-0}^{+0.2} - \varphi_{KW,TrigNW}{}_{-0}^{+0.2}] - 2\cdot[\varphi_{Em-0}^{+8.57} - \varphi_{Em,TrigNW}{}_{-0}^{+8.57}]).$$

Figure 2:
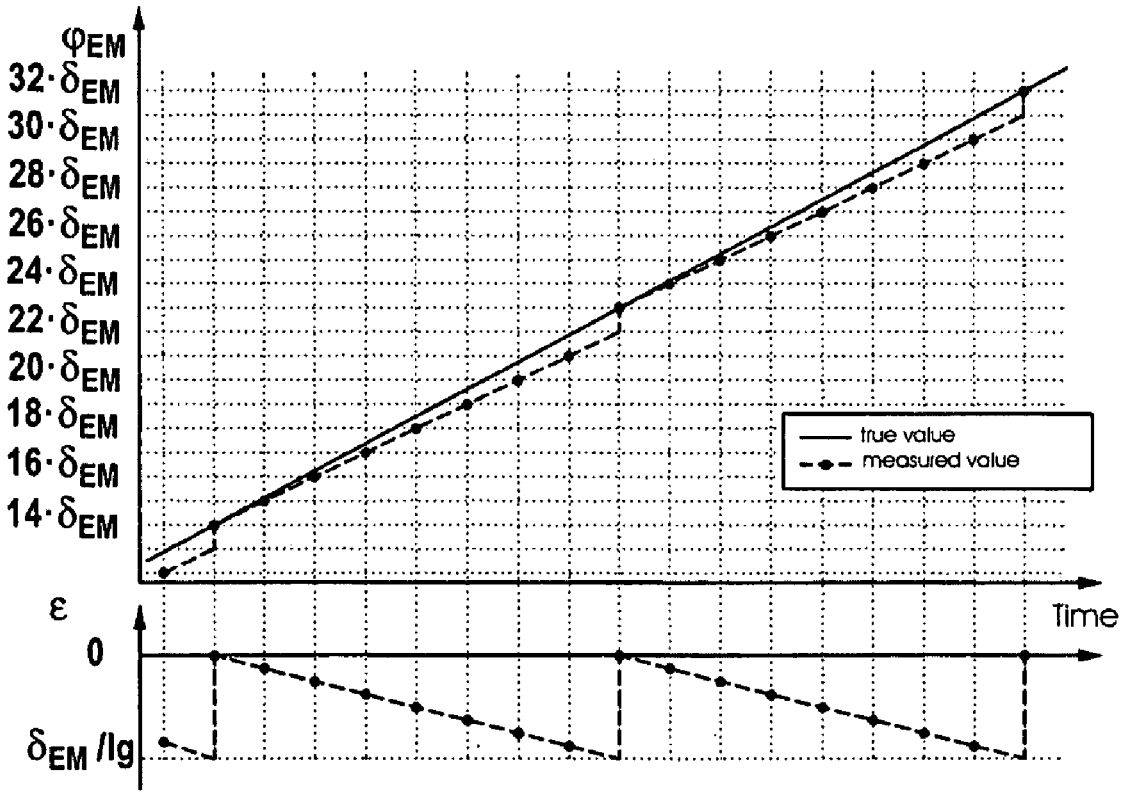
FIG. 2 shows a graph of the actual rotation angle curve and rotation angle measured values of the rotor of an actuating motor of the adjusting device, the time being plotted on the abscissa and the rotation angle being plotted on the ordinate.

As FIG. 2 shows, digitizing the actuating shaft rotation angle causes a type of beat between the points in time when the cyclic interrupt occurs and the points in time when the magnetic segment-sensor combinations change. Under steady-state conditions, EC motor 14 rotates exactly twice as fast as crankshaft 12. As a rule, the points in time when the cyclic interrupt occurs differ from the points in time when the magnetic segment-sensor combinations change. FIG. 2 shows, for example, nine changes in the magnetic segment-sensor combinations within eight interrupt cycles, i.e., per interrupt cycle, the EC motor covers an angle of (9/8)·8.57°. Since only an integral multiple of 8.57° is input into the control unit, the difference between the true actuating shaft rotation angle and the actuating shaft rotation angle processed in the control unit increases until one more Hall sensor pulse then otherwise occurs in the case of a cyclic interrupt and the true and measured actuating shaft rotation angles are again briefly synchronous.

If relative rotation angle position $\Delta\epsilon_{Rel}$ were calculated directly from crankshaft rotation angle $\phi_{KW,TrigNW}$ and actuating shaft rotation angle $\phi_{Em,TrigNW}$, this would yield according to equation (1) jumps in measured rotation angle position $\Delta\epsilon_{Rel}$ amounting to approximately $\Delta\epsilon=2\cdot\delta_{Em}/i_g=0.29°$ and would cause a regulator intervention. This is undesirable, in particular in steady-state operation.

To reduce the magnitude of these jumps or even prevent them completely, an estimate for the rotation angle of the actuating shaft at the reference point in time, which is after the actuating shaft measurement point in time is calculated by extrapolation of at least two actuating shaft rotation angle measured values. As reference points in time, the points in time when the camshaft interrupts occur are selected, as well as the points in time at which the cyclic interrupts are triggered are selected.

Figure 3:
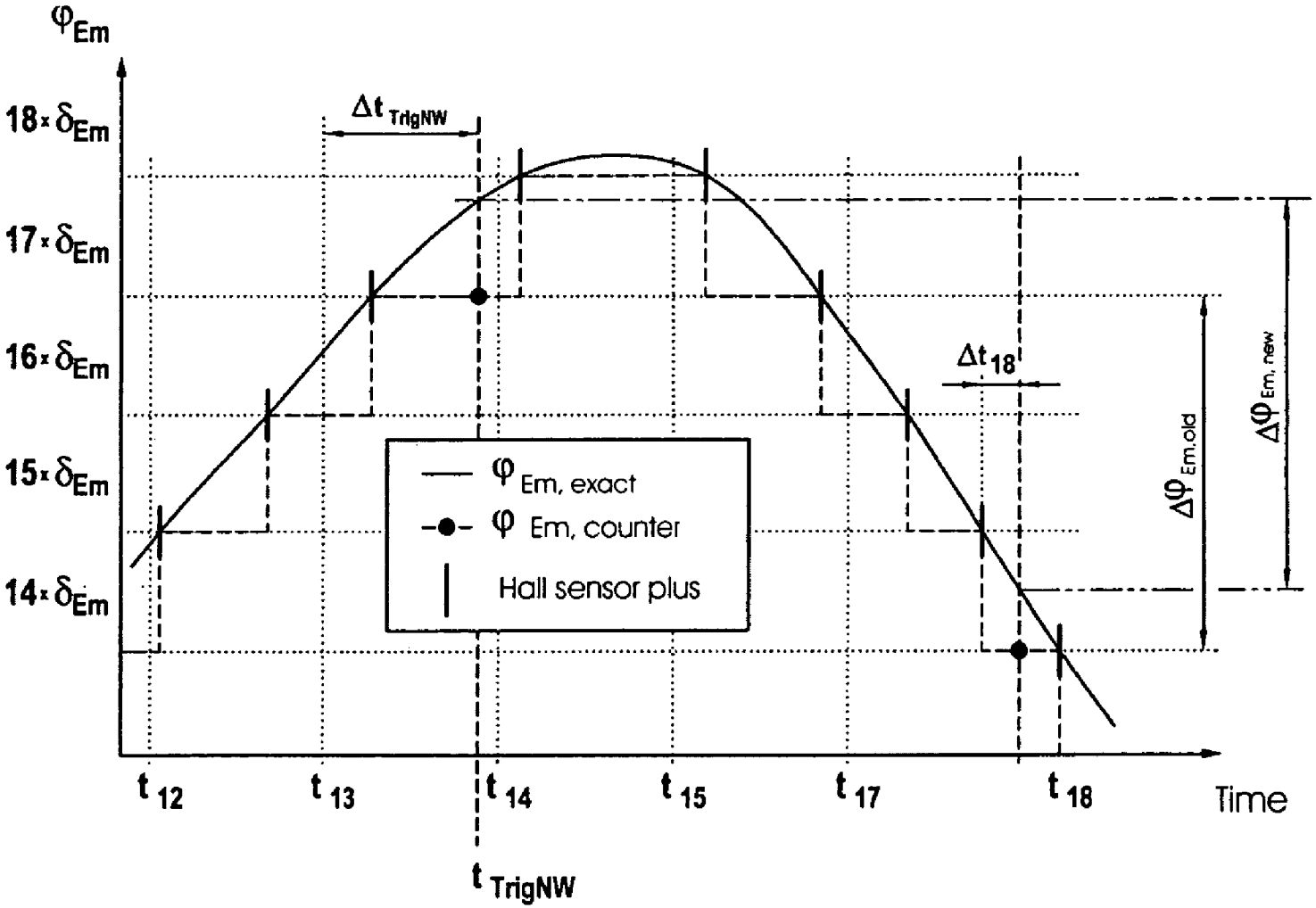
FIG. 3 shows a graph of the actual rotation angle curve of the actuating motor, the points where Hall sensor pulses occur being marked in the rotation angle curve, the time being plotted on the abscissa and the rotation angle being plotted on the ordinate.

The extrapolation is explained below with reference to FIG. 3. At point in time $t_{TrigNW}$ of the camshaft interrupt, counter status $N_{TrigNW}$ of measuring device 17, corresponding to the actuating shaft rotation angle value, plus time $\Delta t_{TrigNW}$ and rotational speed $\omega_{Em,TrigNW}$ (with a plus or minus sign) are available at the latest change of the magnetic segment-sensor combination. Corresponding data may be accessed with each cyclic interrupt $t_i$. For example, counter status $N_{t_{18}}$, differential time $\Delta t_{18}$ and rotational speed $\omega_{Em,t_{18}}$ are available at time $t_{18}$.

With this data, the angle traveled since the occurrence of the latest change in the magnetic segment-sensor combination and thus the EC motor rotation angle and/or the actuating shaft rotation angle at the time of the camshaft trigger and instantaneous control unit interrupt $t_i$ may be determined with a greater precision than in the past from:

$$\phi_{Em,TrigNW}=N_{TrigNW}\cdot\delta_{Em}+\Delta t_{TrigNW}\cdot\omega_{Em,TrigNW}$$

$$\phi_{Em,t_i}=N_{t_i}\cdot\delta_{Em}+\Delta t_i\cdot\Delta_{Em,t_i} \tag{2.1}$$

The differential angle required for calculation of the phase angle at instantaneous control unit interrupt $t_i$ is thus expressed as follows:

$$\Delta\phi_{Em,t_i}=\phi_{Em,t_i}-\phi_{Em,TrigNW}=(N_{t_i}-N_{TrigNW})\cdot\delta_{Em}+[\Delta t_i\cdot\omega_{Em,t_i}-\Delta t_{TrigNW}\cdot\Delta_{Em,TrigNW}]$$

For extrapolation, the instantaneous EC motor rotational speed is needed. The simplest way to determine this is from period of time $\Delta t_{Hall}$ between the latest and the next to the latest actuating shaft measurement point in time or point in time $\Delta t_{Hall}$ between the latest and the next to the latest change in the magnetic segment-sensor combination (this information is directly available without any time lag). Together with plus or minus sign S for the direction of counting, this yields:

$$\omega_{Em} = S\cdot\frac{\delta_{Em}}{\Delta t_{Hall}}.$$

This method is very simple, but it may yield values that fluctuate greatly because times $\Delta t_{Hall}$ between changes in the magnetic segment-sensor combination may also be very irregular even at a constant rotational speed due to manufacturing tolerances. Essentially to improve results, averaging over several actuating shaft rotation angle values is possible. However, it should be noted that the average may only be calculated with a time lag, so that when EC motor 14 accelerates, this error also enters into the extrapolation. In the control unit interrupt, instantaneous rotational speed $\omega_{Em}$ of EC motor 14 is also calculated for regulation of the phase angle.

It is explained below on the basis of FIGS. 4 through 7 how the effect of the errors occurring due to the aforementioned manufacturing tolerances on the rotation angle position of the camshaft may be reduced in relation to the crankshaft without any time lag.

Figure 4:
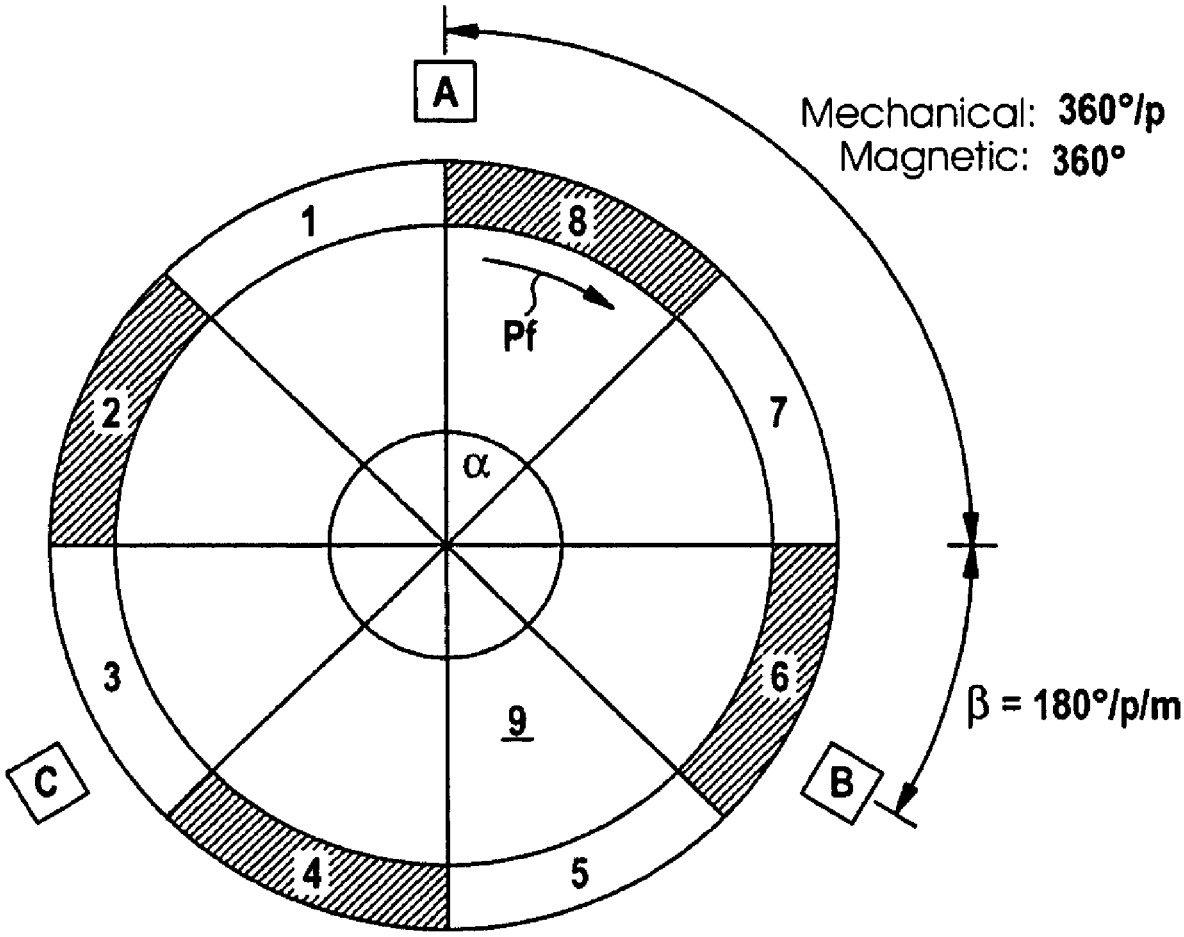
FIG. 4 shows a schematic view of the end of the rotor of an EC motor, magnetic segments being situated on the circumference of the motor and a position measuring device being provided for detecting the position of the rotor in relation to the stator.

In the exemplary embodiment shown in FIG. 4, the rotor has eight magnetic segments 1 through 8 which are offset in relation to one another in a grid of 45° in the circumferential direction of a carrier part 9 to which magnetic segments 1 through 8 are attached. Magnetic segments I through 8 each form a magnetic pole on the circumference of the rotor, so that a number of p pole pairs is formed over the circumference. This is shown in FIG. 4 as an example for a rotor having p=4 pole pairs. On the ring formed by magnetic segments I through 8, the magnetization thus changes directions eight times per revolution. As already mentioned, magnetic segments 1 through 8 have tolerances with regard to their position and also with regard to their dimensions. Mechanical angle $\alpha$ between corresponding locations of neighboring magnetic segments 1 through 8 may thus deviate from setpoint 180°/p (here: 45°). The direction of rotation of the rotor is indicated by arrow Pf in FIG. 4.

The output signal of magnetic field sensor A changes with each revolution of the rotor by angle $\alpha$. Thus a resolution $\alpha$ of the rotor rotation angle may be achieved merely with the help of magnetic field sensor A. As shown in FIG. 4, sensors A, B and C are arranged offset in relation to one another on the circumference of the rotor. The offset is selected in such a way that position measurement signals detected with the help of sensors A, B, C have a resolution of 180°/(p·m). This is achieved by the fact that magnetic field sensor B is offset by a mechanical angle of 180°/(p·m) plus an integral multiple of $\beta$=180°/m in comparison with magnetic field sensor A, and magnetic field sensor C is offset by double this mechanical angle in comparison with magnetic field sensor A in forward direction of rotation Pf.

Figure 5:
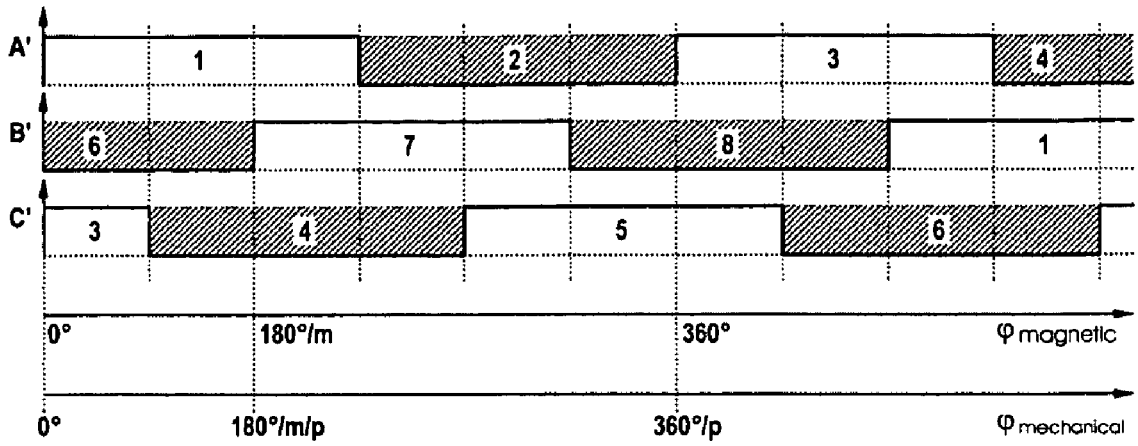
FIG. 5 shows a graph of a position measurement signal detected with the help of the position measuring device.

FIG. 5 shows graphically a section of the actuating shaft rotation angle signal composed of output signals A', B', C' of sensors A, B, and C for rotation to the right in the direction of arrow Pf. Output signal A' is associated with magnetic field sensor A; output signal B' is associated with magnetic field sensor B, etc. Output signals A', B', C' are digital signals which may assume logic values of 1 or 0. A value of 1 occurs if a magnetic segment 1 through 8 forming a north pole is opposite particular sensor A, B, C. Similarly, output signal A', B', C' assumes a logical value of 0 when a magnetic segment 1 through 8 forming a south pole is opposite a particular sensor A, B, C.

To illustrate the assignment of individual values of an output signal to particular magnetic field section 1 through 8 moving past particular sensor A, B, C at that point in time, the reference numeral of the particular magnetic field section 1 through 8 is given at the output signal values. FIG. 5 shows magnetic rotation angle $\phi_{magnetic}$ and mechanical rotation angle $\phi_{mechanical}$ both plotted on the abscissas beneath the output signals. It is clearly discernible here that for a mechanical rotation of 360°/p (=90°), the actuating shaft rotation angle signal assumes in succession 2·m (=6) different states, which are then repeated.

The actuating shaft angle signal composed of output signals A', B' and C' is relayed for analysis to the control unit which is connected to magnetic field sensors A, B, C. Only output signals A', B' and C' are known to the control unit, but the latter does not know which magnetic segments 1 through 8 are moving past sensors A, B, C at that time.

FIG. 5 shows that one of the magnetic segment-sensor combinations is always active at a given point in time. In FIG. 5, these are the magnetic segment-sensor combinations (1,6,3), (1,6,4), (1,7,4), (2,7,4), (2,7,5), (2,8,5), etc., from left to right. This sequence of magnetic segment-sensor combinations is repeated after 2·p magnetic segments 1 through 8 have passed by a magnetic field sensor A, B, C, i.e., after a full mechanical rotation.

The total rotation angle of the rotor is determined by counting the changes at which the position measurement signal changes its value. Based on a starting value, the total angle is incremented with each change.

The actuating shaft rotation angle signal thus determined is differentiated to form a rotational speed signal. This may be accomplished, for example, by measuring time Δt between two changes in the actuating shaft rotation angle signal and determining rotational speed ω as follows:

$$\omega = \frac{\pi}{(m \cdot p \cdot \Delta t)} (\mathrm{rad}/s).$$

Due to the tolerances in magnetic segment 1 through 8, rotational speed signal $\omega_{Meas,i}$ thus determined is subject to errors, which result in jumps in the rotational speed signal at a constant actual rotational speed of the rotor, for example.

In the control unit, the magnetic segment-sensor combinations are numbered continuously from 1 through 2·m·p so that the numerical value, referred to below simply as "index i," is incremented and then jumps back to 1 on reaching 2·m·p. When the EC motor is turned on, index i is set at a starting value, e.g., at value 1.

For each magnetic segment-sensor combination, a correction factor $F_{Adap}[i]$ is determined and associated with corresponding magnetic segment 1 through 8 via index i. This correction factor $F_{Adap}[i]$ corresponds to the ratio between rotational speed value $\omega_{Meas,i}$, which was determined with the help of the actuating shaft rotation angle signal for the ith magnetic segment-sensor combination and a reference rotational speed value $\omega_{Ref}$ which is assumed to have a greater accuracy than rotational speed value $\omega_{Meas,i}$. Correction factors $F_{Adap}[i]$ are stored in a data memory of the control unit.

With the help of correction factor $F_{Adap}[i]$, a corrected rotational speed value $\omega_{Corr,i}$ is determined for each rotational speed value $\omega_{Meas,i}$ as follows:

$$\omega_{Corr,i} = \frac{\omega_{Meas,i}}{F_{Adap}[i]}$$

Correction factors $F_{Adap}[i]$ are determined in a learning process. At the start of the learning process, all correction factors $F_{Adap}[i]$ are set a value of 1, i.e., corrected rotational speed $\omega_{Corr,i}$ corresponds first to measured rotational speed $\omega_{Meas,i}$. During the learning process, correction factors $F_{Adap}[i]$ are limited to a value range between 0.8 and 1.2 to limit the extent of the error in the event of faulty adaptation, which is not entirely to be ruled out in practice.

Figure 6:
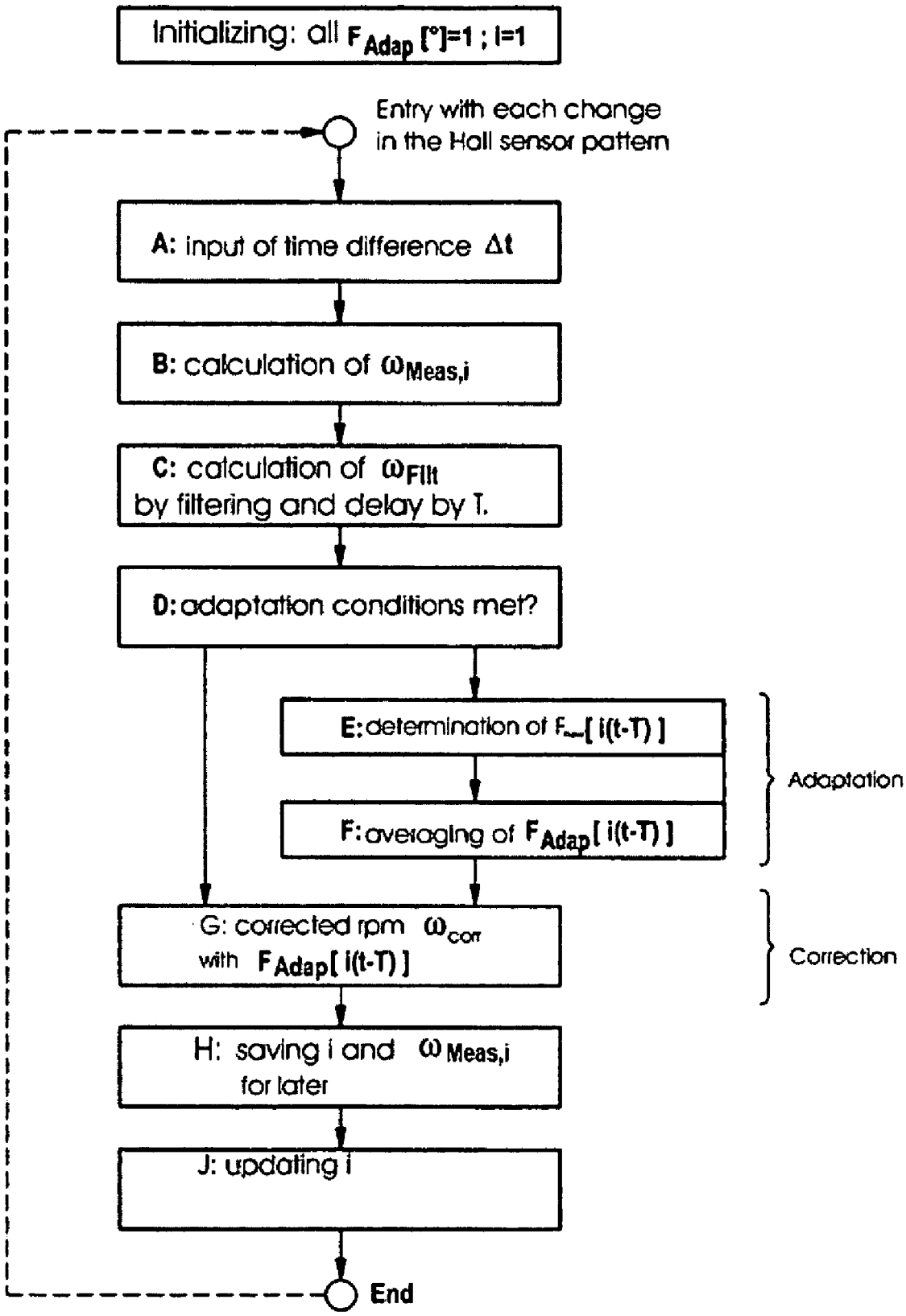
FIG. 6 shows a flow chart illustrating the individual steps in correcting an angular velocity signal generated from the position measurement signal.

As FIG. 6 shows, the following sequence is always run through when a change in the actuating shaft rotation angle signal is detected. The instantaneous point in time is designated as t.

A: Storing difference time Δt between the latest change and the present change in the magnetic segment-sensor combination. It indicates how long it has taken to pass by the previously active magnetic segment-sensor combination. Index i, which is adapted at the end of the sequence for retrieval of the next sequence, points to the measured value of the position measurement signal associated with this magnetic segment-sensor combination.

B: Calculating uncorrected rotational speed $$\omega_{Meas,i} = \frac{\pi}{(m \cdot p \cdot \Delta t)}.$$

C: Filtering the uncorrected rotational speed: since true rotational speed $\omega_{True}$ is unknown, the reference signal for the rotational speed is formed by filtering the uncorrected rotational speed. Result $\omega_{Ref}$ of the filtering agrees relatively well with the actual speed before T seconds, $\omega_{Ref}(t) \approx \omega_{True}(t-T)$, where T is the lag time of the filter which depends on the type and order of the filter.

D: Checking the adaptation prerequisites. For example, the correction factor is not adapted if the direction of rotation of the rotor has changed. Furthermore, adaptation of the correction factor is suspended during a phase of high acceleration and/or deceleration of the rotor because the filtered rotational speed then presumably would not exactly match the actual rotational speed.

E: The actual correction factor for the latest magnetic segment-sensor combination is obtained as the quotient from calculated rotational speed $\omega_{Meas,i}(t)$ and true rotational speed signal $\omega_{True}(t)$:

$$F_{True}[i] = \omega_{Meas,i}(t)/\omega_{True}(t)$$

Since true rotational speed $\omega_{True}$ is available only with a delay T in the form of reference rotational speed $\omega_{Ref}$, all other parameters involved must also be delayed. Therefore, index i and uncorrected rotational speed values $\omega_{Meas,i}$ are stored in a shift register so that their delay values are now available. The correction factor is thus obtained as follows:

$$F[i(t-T)] = \omega_{Meas,i}(t-T)/\omega_{Ref}(t).$$

F: Averaging for the correction factor: Correction factor F still has a certain inaccuracy because rotational speed reference value $\omega_{Ref}$ only approximately corresponds to actual rotational speed value $\omega_{True}$. New correction factors are therefore determined each time at the individual rotations of the rotor, these correction factors which are gradually determined for the particular magnetic segment-sensor combination being averaged by forming a sliding average:

$$F_{new}[i(t-T)]=\lambda F_{old}[i(t-T)]+(1-\lambda)F[i(t-T)]$$

where $F_{new}$ is the prevailing correction factor average, $F_{old}$ is the average determined in the previous clock cycle and $\lambda$ is a forgetting factor, which may be between 0 and 1. The greater $\lambda$, the longer are past values $\omega_{Meas,i}(t)$ taken into account.

G: The correction is performed using instantaneous values i(t) and $\omega_{Meas,i}(t)$. The measured value is corrected using correction factor F[i] adapted up to that point:

$$\omega_{Corr,i}=\omega_{Meas}(t)/F[i].$$

Correction of the rotational speed signal is performed with the help of the magnetic segment-sensor combination just previously passed by, but older values are used for adaptation of correction factors F[i].

H: Saving i and $\omega_{Meas,i}$ in the shift register to allow access to these values again later as historical values.

J: To prepare for the sequence, index i is incremented on the basis of the old magnetic segment-sensor combination. If index i exceeds interval [1 through 2·p·m], it is set at 1. Index i now indicates the instantaneous magnetic segment-sensor combination.

A critical point in the adaptation is the accuracy with which the actual rotational speed is approximated. In the exemplary embodiment described above, this approximation is achieved by filtering the measured rotational speed. However, it is also possible to filter rotational speeds that have already been corrected. If a different measurement signal is available which permits an inference as to the actual rotational speed, this may also be used.

In shutting down the device including the EC motor and the control unit, the 2·p·m learned correction factors are written into a nonvolatile data memory of the control unit. At the start of adaptation, index i is set at an arbitrarily selected starting value in the case of a magnetic segment-sensor combination which just happened to be active and this magnetic segment-sensor combination is not initially known after turning on the control unit again, so the assignment of correction factors to the magnetic segment-sensor combinations must be checked and corrected if a defective assignment is detected, so that the correction factors may continue to be used after reactivating the control unit.

The same problems already occur during adaptation if it has been performed incorrectly due to signal interference or has not been performed at all, so that index i is updated incorrectly and thus correction factors are assigned to magnetic segment-sensor combinations which are shifted with respect to the magnetic segment-sensor combinations for which the correction factors were determined. In such a case, corrected rotational speed $\omega_{Corr}$ may deviate from the actual rotational speed much more than the uncorrected rotational speed.

The correct sequence of the 2 m (=6) successive position measurement signal states is stored in the data memory of the control unit. It is compared with the sequence of the states of the position measurement signal. If a deviation is found, this error is eliminated in the next retrieval of the sequence. The change in the magnetic segment-sensor combinations is unambiguous within ±m changes. If it is certain that the direction of rotation of the rotor was retained during the interference, then even (2 m−1) updates may be corrected.

The quality of the adaptation is monitored by comparing the range of fluctuation of the uncorrected and corrected rotational speed repeatedly over a certain time window. If the corrected rotational speed deviates more than the uncorrected rotational speed, a faulty assignment is inferred. The assignment is either restored or the correction factors are set at 1.

In restoring the assignment, it is assumed that the numerical sequence of the 2·p·m correction factors represents a type of characteristic signature. If a new set of correction factors is adapted, they must have a very similar numerical sequence, but the new numerical sequence may be shifted in comparison with the previous numerical sequence. To restore the assignment, the old numerical sequence is therefore shifted cyclically 2·p·m times, and after each shift step, it is compared with the previous numerical sequence. With the particular permutation and/or shift combination at which the greatest correspondence occurs between the old numerical sequence and the previous numerical sequence, it is assumed that the numerical values of the old numerical sequence have been correctly associated with the magnetic segment-sensor combinations. The correction of the rotational speed signal and/or further adaptation is/are performed using this association.

In another exemplary embodiment of the present invention, the procedure described below is followed:

First, a first data set is determined using a number of value combinations corresponding to the number of magnetic segment-sensor combinations, each including at least one correction factor for the particular magnetic segment-sensor combination and one measurement signal state associated with it, and stored. An exemplary embodiment of such a data set for an EC motor 4 having three magnetic field sensors and three pole pairs is shown graphically in the upper half of FIG. 7.

The magnetic segment-sensor combinations for which the correction factors have been determined are then run through again, a new second data set having value combinations being determined and stored. This second data set is shown graphically at the bottom of FIG. 7.

The measurement signal states of the first and second data sets are then compared. If a deviation is detected, the value combinations of the data sets are shifted cyclically in relation to one another so that the measurement signal states of the data sets match. In the exemplary embodiment according to FIG. 7, this may be accomplished by shifting the value combinations of the old adaptation cyclically to the right by three positions.

Figure 7:
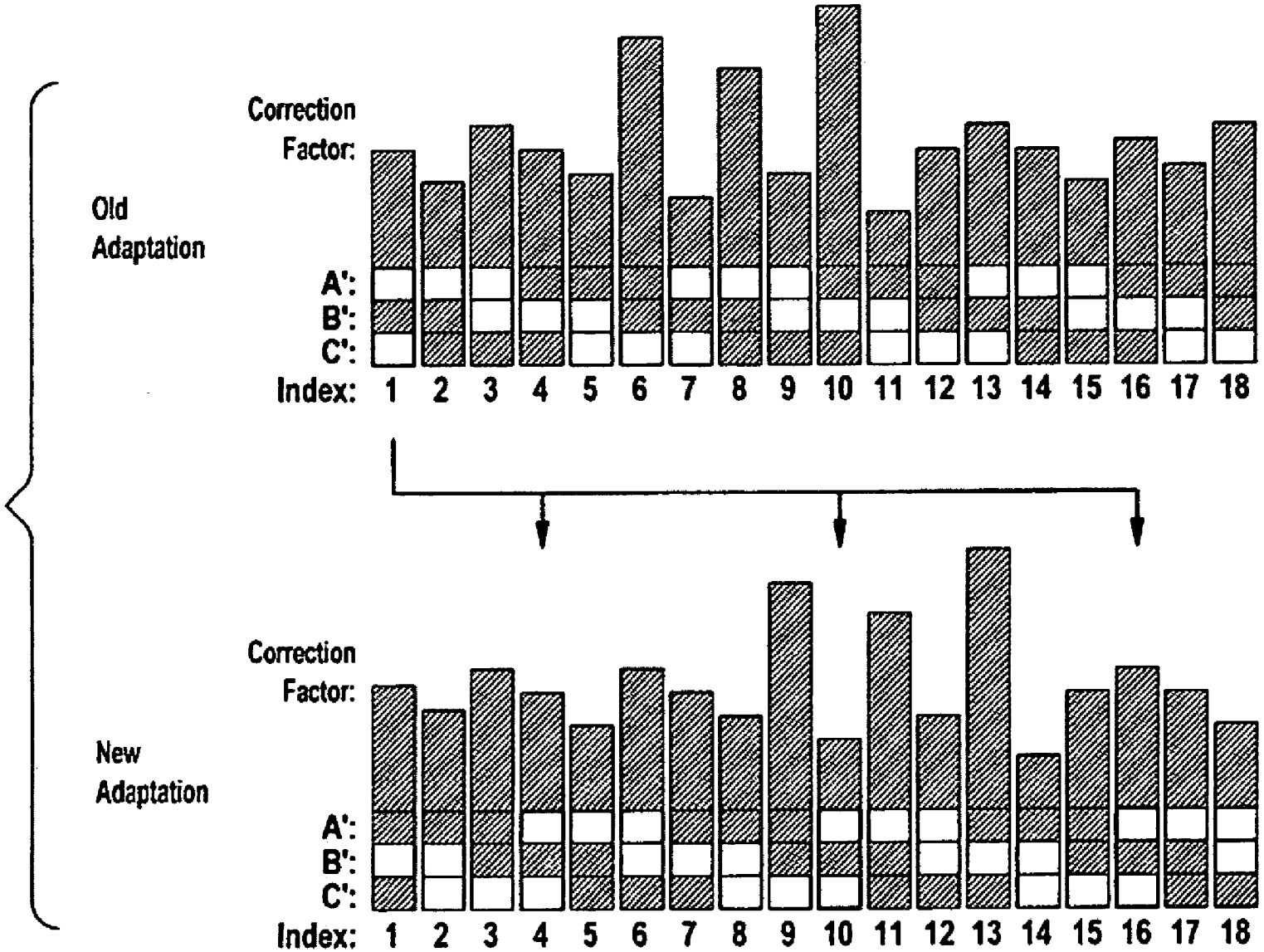

The correction factors of the data sets associated with one another are then compared, so the correction factor having index i=1 of the first data set in FIG. 7 is compared with the correction factor having index i=4 of the second data set; the correction factor having index i=2 of the first data set is compared with the correction factor having index i=5 of the second data set, etc.

In a subsequent step, the correction factors of the first data set are permutated cyclically by a number of steps corresponding to twice the number of the magnetic field sensors (i.e., 2·p=6 steps) in relation to the correction factors of the other data set and then the correction factors of the data sets associated with one another are compared. This step is repeated until all permutations have been processed.

Next, the permutation at which a maximum correspondence between the correction factor sets is achieved is determined. With this permutation, an average is formed from the correction factors associated with one another of the correction factor sets and stored as the new correction factor. The rotational speed measurement signal is then corrected using the new correction factors determined in this way.

Therefore, it is not necessary to perform shifts 2·p·m times. One need only determine which of the p magnetic periods is most suitable. During the period of time in which the new correction factors are being adapted, the corrected rotational speed is either calculated using factor 1 or using the newly adapted correction factors up to that point in time.

What is claimed is:

1. A method for determining a rotation angle position for a camshaft of a reciprocating-piston engine relative to a crankshaft, the crankshaft being in a drive connection with the camshaft via a three-shaft actuating gear, the actuating gear including a drive shaft fixedly attached to the crankshaft, an output shaft fixedly attached to the camshaft and an actuating shaft in drive connection with an actuating motor, the method comprising:

determining at least one crankshaft rotation angle measured value for the crankshaft rotation angle for at least one respective crankshaft measurement point in time;

digitally determining at least two actuating shaft rotation angle measured values for the actuating shaft rotation angle for at least two respective actuating shaft measurement points in time;

extrapolating an estimate for the rotation angle of the actuating shaft at a reference point in time from the at least two actuating shaft rotation angle measured values, a time difference between the actuating shaft measurement points in time, and an interval between the latest actuating shaft measurement point in time and the reference point in time, wherein the reference point in time is after the crankshaft and actuating shaft measurement points in time; and determining the rotation angle position value for the camshaft relative to the crankshaft based on the estimate, at least one crankshaft rotation angle measured value, and a transmission characteristic of the three-shaft transmission.

2. The method as recited in claim 1, further comprising determining an angular velocity value of the actuating shaft for the latest actuating shaft measurement point in time, and wherein the estimate is determined from the latest actuating shaft rotation angle measured value, the interval between the reference point in time and the latest actuating shaft measurement point in time, and the angular velocity value.

3. The method as recited in claim 2, wherein the actuating motor is an EC motor having a stator that includes a winding, a rotor non-rotatably connected to the actuating shaft, a plurality of magnet segments each having a tolerance with regard to at least one of their positioning and their dimensions, the plurality of magnet segments being disposed on the rotor so as to be offset relative to one another in the circumferential direction and magnetized alternately in opposite directions, wherein the determining of at least one of the actuating shaft rotation angle measured values and the angular velocity values includes detecting the positioning of the magnetic segments relative to the stator, detecting at least one correction value for compensating an effect of at least one tolerance on the actuating shaft rotation angle measured values; and correcting at least one of the actuating shaft rotation angle measured values and the angular velocity values using the correction value.

4. The method as recited in claim 3, wherein the detecting of the positioning of the magnetic segments is performed using a measuring device having a plurality of magnetic field sensors disposed offset in the circumferential direction of the stator so that a plurality of magnetic segment-sensor combinations is passed through per revolution of the rotor relative to the stator, and the detecting of the at least one correction value includes determining and storing a first correction value for each of the magnetic segment-sensor combinations.

5. The method as recited in claim 4, further comprising:

rotating the rotor relative to the stator so as to pass through the plurality of magnetic segment-sensor combinations, detecting uncorrected actuating shaft rotation angle measured values and/or angular velocity values for the magnetic segment-sensor combinations using the measuring device;

determining reference values for the actuating shaft rotation angle and/or the angular velocity, the reference values having a higher accuracy than the first actuating shaft rotation angle measured values and/or angular velocity values;

determining correction values as correction factors using the first uncorrected actuating shaft rotation angle measured values and/or angular velocity values;

rotating the rotor relative to the stator so as to again pass through the magnetic segment-sensor combinations associated with the first uncorrected actuating shaft rotation angle measured values and/or angular velocity values;

detecting second uncorrected actuating shaft rotation angle measured values and/or angular velocity values using the measuring device; and correcting the second uncorrected values using the previously determined correction factors.

6. The method as recited in claim 5, wherein the determining of the reference values includes smoothing the first uncorrected actuating shaft rotation angle measured values and/or angular velocity values by filtering.

7. The method as recited in claim 4, wherein the rotor is rotated relative to the stator so as to pass through each of the individual magnetic segment-sensor combinations at least twice, wherein a plurality of first correction factors is determined for the each individual magnetic segment-sensor combination during the first pass-through, wherein the correction factor is determined as an average the plurality of first correction factors, and wherein the actuating shaft rotation angle measured values and/or angular velocity values are corrected using the correction factor on the second pass-through.

8. The method as recited in claim 7, wherein the average is formed using an arithmetic mean.

9. The method as recited in claim 7, wherein the average is a sliding average having different weighting of the plurality of first correction factors.

10. The method as recited in claim 9, wherein the weighting of the first correction factors decreases with increasing age of the first correction factors.

11. The method as recited in claim 10, wherein sliding averages $F_{new}[i(t-T)]$ for the individual magnetic segment-sensor combinations are determined cyclically according to formula $F_{new}[i(t-T)]=\lambda F_{old}[i(t-T)]+(1-\lambda)F[i(t-T)]$, where i is an index identifying the particular magnetic segment-sensor combination, t is the time, T is a lag time between the actual angular velocity and the measured angular velocity values, $F_{old}[i(t-T)]$ is the average determined in the latest averaging at index i and λ is a forgetting factor that is greater than zero and less than one.

12. The method as recited in claim 11, wherein the forgetting factor is between 0.7 and 0.9.

13. The method as recited in claim 4, wherein a) the rotor is rotated in relation to the stator, and the correction factors for the individual magnetic segment-sensor combinations are determined and stored, b) the corresponding magnetic segment-sensor combinations are run through again thereafter, determining a set of new correction factors, c) the correction factors of the old correction factor set are permutated cyclically in relation to those of the new correction factor set and the correction factor sets are then compared, d) step c is repeated until all permutations of the old correction factor set have been compared with the new correction factor set, e) the permutation at which a maximum correspondence with the new correction factor occurs is determined, f) and the angular velocity values are corrected with the arrangement of correction values of the old correction factor set associated with this permutation.

14. The method as recited in claim 13, wherein an average is formed from the correction factors of the old correction factor set and the new correction factor set associated with one another in the permutation at which a maximum correspondence between the correction factor sets occurs, and wherein the average is stored as the new correction factor and the angular velocity values are corrected using the correction factor set obtained by the averaging.

15. The method as recited in claim 4, wherein a) the rotor is rotated in relation to the stator in such a way that all magnetic segment-sensor combinations are run through at least once, b) a position measurement signal of the magnetic field sensors is generated in such a way that a number of measurement signal states is run through per revolution of the EC motor for each pole pair of the rotor, c) a first data set is determined using a number of value combinations corresponding to the magnetic segment-sensor combinations, each including at least one correction factor for the particular magnetic segment-sensor combination and a measurement signal state assigned thereto, and stored, d) thereafter the corresponding magnetic segment-sensor combinations are again run through, whereupon a new second data set is determined with value combinations and stored, e) if there is a deviation between the measurement signal states of the first data set and those of the second data set, the value combinations of the first data set are cyclically shifted in relation to those of the second data set in such a way that the measurement signal states of the data sets correspond, f) the particular correction factors of the data sets associated with one another are then compared, g) the correction factors of one data set are permutated cyclically by a number of steps corresponding to twice the number of magnetic field sensors in relation to the correction factors of the other data set and thereafter the particular correction factors of the data sets associated with one another are compared, h) step g) is repeated, if necessary, until all permutations have been processed, i) a permutation at which a maximum correspondence between correction factors of the data sets occurs is determined, j) and the angular velocity values are corrected with the arrangement of correction values of the first data set associated with the permutation.

16. The method as recited in claim 15, wherein an average is formed from the correction factors of the first and second data sets associated with one another in the permutation at which a maximum correspondence between the correction factors of the data sets occurs and this average is stored as the new correction factor, and the angular velocity values are corrected with the correction factors obtained by the averaging.

17. The method as recited in one claim 5, wherein a range of variation in the uncorrected angular velocity values and the corrected angular velocity values in a time window are determined and compared and for the case when the range of variation in the corrected angular velocity values is greater than that of the uncorrected angular velocity values, the correction factors are determined anew and/or the association of the correction factors to the magnetic segment-sensor combinations is restored.

18. The method as recited in claim 5, wherein the correction factors are limited to a predetermined value range.

19. The method as recited in claim 18, wherein the predetermined value range between 0.8 and 1.2.

20. The method as recited in claim 1, wherein a moment of inertia value is determined for a mass moment of inertia of the rotor;

a current signal I is determined by determining a current value I(k) for the electric current in the winding for the individual actuating shaft measurement points in time;

an estimate $\omega_s(k)$ for angular velocity value ω(k) is determined for individual angular velocity values ω(k) from an angular velocity value $\omega_k(k-1)$ associated with an earlier actuating shaft measurement point in time as well as from current signal I and the moment of inertia value;

a tolerance band containing estimate $\omega_s(k)$ is associated with this estimate $\omega_s(k)$, and for the case when angular velocity value ω(k) is outside the tolerance band, angular velocity value ω(k) is replaced by an angular velocity value $\omega_k(k)$ that is inside the tolerance band.

21. The method as recited in claim 20, further comprising:

applying a load torque to the rotor;

supplying a load torque signal $M_L$ for the load torque, and wherein the estimate $\omega_s(k)$ is determined from angular velocity value $\omega_k(k-1)$ associated with the earlier sampling point in time, current signal I, load torque signal $M_L$ and the moment of inertia value.

22. The method as recited in claim 21, wherein the electric voltage applied to the winding is determined and current values I(k) are determined indirectly from the voltage, the impedance of the winding, angular velocity values $\omega_k(k)$, corrected if necessary, and a motor constant.

23. The method as recited in claim 20, wherein the tolerance band is limited by boundary values, and angular velocity values ω(k) outside of the tolerance band are corrected to the boundary value of the nearest tolerance band.

24. The method as recited in claim 20, wherein at least one of a width and a position of the tolerance band is selected as a function of the angular velocity value $\omega_k(k-1)$ associated with the earlier actuating shaft measurement point in time.

25. The method as recited in claim 24, wherein the at least one of the width and the position is reduced with an increase in angular velocity and/or increased with a decrease in angular velocity.

26. The method as recited in claim 20, wherein at least one of a width and a position of the tolerance band is selected as a function of current signal I.

27. The method as recited in claim 26, wherein the at least one of the width and the position is increased with an increase in current and/or decreased with a reduction in current.

28. The method as recited in claim 20, wherein the current signal I is smoothed by filtering and estimates $\omega_s(k)$ for angular velocity values $\omega(k)$ are determined with the help of the filtered current signal.

29. The method as recited in claim 28, wherein the filtering includes performing a sliding averaging.

30. The method as recited in claim 1, wherein an estimate for the rotation angle of the crankshaft at the reference point in time is extrapolated from at least two crankshaft rotation angle measured values, the time difference between the crankshaft rotation angle measurement points in time associated with the measured values, and from the time interval between the latest crankshaft measurement point in time and the reference point in time, wherein the time interval between the reference point in time and the latest crankshaft measurement point in time is determined, and wherein the estimate is determined from the crankshaft rotation angle measured value at the latest crankshaft measurement point in time, the time difference and the angular velocity value.

* * * * *